US005746428A

United States Patent [19]

Fredenburg

[11] Patent Number: 5,746,428

[45] Date of Patent: May 5, 1998

[54] DICE MARKED TO PERMIT FAIR AND MATHEMATICALLY SIMPLE BETTING ODDS IN CRAPS

[76] Inventor: Edward A. Fredenburg, 2204 Enterprise Dr., Richland, Wash. 99352

[21] Appl. No.: 889,933

[22] Filed: Jul. 10, 1997

[51] Int. Cl.[6] ..... A63F 9/04

[52] U.S. Cl. ..... 273/146; 273/274

[58] Field of Search ..... 273/146, 274

[56] References Cited

U.S. PATENT DOCUMENTS

| | | | |
|---|---|---|---|
| 4,989,879 | 2/1991 | Nigh | 273/146 X |
| 5,090,706 | 2/1992 | Hokanson | 273/146 X |
| 5,620,183 | 4/1997 | Skratulia | 273/146 |
| 5,649,704 | 7/1997 | Dobbin | 273/146 X |
| 5,688,126 | 11/1997 | Merritt | 273/146 X |
| 5,690,335 | 11/1997 | Skratulia | 273/146 X |

*Primary Examiner*—William E. Stoll
*Attorney, Agent, or Firm*—Floyd E. Ivey

[57] ABSTRACT

This invention provides dice with integers assigned to die faces in such manner to permit fair and mathematically simple betting odds in the game of craps. Using the dice of this invention the probabilities of "pass" and "don't pass" outcomes are equal, and fair payoffs on winning "place" bets and "point" bets for each of the numbers 4, 5, 6, 8, 9, and 10 are integer multiples of the amount bet.

14 Claims, 2 Drawing Sheets

DICE MARKED TO PERMIT FAIR AND MATHEMATICALLY SIMPLE BETTING ODDS IN CRAPS

FIELD OF THE INVENTION

This invention relates to games of chance, specifically to dice marked in such manner to give fair and mathematically simple betting odds in the game of craps.

BACKGROUND OF THE INVENTION

Heretofore, two dice have been used in the game of craps to randomly generate numbers ranging from 2 to 12. Each die is in the shape of a cube having six faces. The faces on each die are marked with the integers 1 through 6. A random number is obtained by rolling two such dice on a playing surface and summing the integers on the top faces of the two dice after they come to rest. Craps players have a variety of betting options. A "pass" or "don't pass" bet may be made before the first roll of the dice ("comeout") starting a shooter's turn. A "come" or "don't come" bet may be made after a "point" (4, 5, 6, 8, 9, or 10) is established on the shooter's "comeout." A "pass" or "come" bettor wins, and a "don't pass" or "don't come" bettor loses when either of the following occurs:

(a) 7 or 11 occurs on the first roll of the dice after the bet, or (b) the "point" is repeated on a subsequent roll before 7 occurs.

A "pass" or "come" bettor loses and a "don't pass" or "don't come" bettor wins when either of the following occurs:

(a) "craps" (2, 3, or 12) occurs on the first roll of the dice after the bet, or (b) 7 is rolled before repeating the "point".

The probability of a winning "pass" or a winning "come" bet is given by the fraction $^{244}/_{495}$. The probability of a winning "don't pass" or a winning "don't come" bet is given by the fraction $^{251}/_{495}$. Thus "don't pass" and "don't come" bets are slightly more likely to win than "pass" and "come" bets. However, players conventionally place "pass," "don't pass," "come," and "don't come" bets at even odds. In gambling establishments, decisions on certain outcomes are often disallowed to ensure a house "advantage."

In craps a player may also bet that one of the numbers 4, 5, 6, 8, 9, or 10 will be rolled before the number 7. Such a bet is called a "place" bet or a "point" bet depending on whether the number was selected by the player or established as the "point" on a "comeout" or on the first roll after the player makes a "come" bet. The odds against winning a "place" bet or "point" bet on the numbers 4 or 10 are two to one. A fair winning payoff on this bet would return the bettor three times the amount bet, including his bet. The odds against winning a "place" bet or "point" bet on the numbers 5 or 9 are three to two. A fair winning payoff on this bet would return the bettor 2.5 times the amount bet, including his bet. The odds against winning a "place" bet or "point" bet on the numbers 6 or 8 are six to five. A fair winning payoff on this bet would return the bettor 2.2 times the amount bet, including his bet. To avoid making disadvantageous "place" bets and "point" bets on the numbers 5, 6, 8, and 9, the bettor must be careful to wager an amount that will ensure a fair payoff.

Thus, in the game of craps the use of two conventional dice slightly favors "don't pass" and "don't come" bettors and slightly penalizes "pass" and "come" bettors. Also in the game of craps, using two conventional dice, fair payoffs on winning "place" bets and "point" bets on the numbers 5, 6, 8, or 9 are not integer multiples of the amount wagered. This places a burden on the bettor to wager an amount that will ensure a fair payoff.

SUMMARY OF THE INVENTION

The combination of a first cube shaped die whose six faces, constituting a first, second, third, fourth, fifth and sixth face, are marked randomly with symbols representing the value of integers 1, 2, 3, 5, 5, and 6, and a second cube shaped die whose six faces, constituting a first, second, third, fourth, fifth and sixth face, are marked randomly with symbols representing the value of integers 1, 1, 4, 4, 6, and 6 may be used to generate random numbers such that the probabilities of both "pass" and "don't pass" outcomes are each ½ when used in playing the game of craps. Each of the six faces of the first and the second die are marked with symbols representing one of the stated values. It is seen that when using such a combination of dice in the game of craps the fair payoff for "place" bets and "point" bets on any of the numbers 4, 5, 6, 8, 9, or 10 is equal to integer multiples of the amount bet. Unlike conventional dice numbered 1 through 6 on each of their faces, this invention allows for fair payoffs on "pass" bets, "don't pass" bets, "come" bets, and "don't come" bets at even betting odds. Also, unlike conventional dice, this invention allows for payoffs on "place" bets and "point" bets equal to integer multiples of the amount bet, and therefore removes from the "place" bettor and "point" bettor the burden to match amounts wagered to the fair mathematical payoff possible. The markings of the six faces of the respective die may be with numbers or symbols including, for example, spots.

The combination of two dice marked as described herein result in fair and mathematically simple betting odds in the game of craps as a consequence of the fact that there are six unique combinations of die faces that generate each of the random numbers 6, 7, and 9; four unique combinations of die faces that generate the random number 11; and two unique combinations of die faces that generate each of the random numbers 2, 3, 4, 5, 8, 10, and 12. Using a pair of dice marked in this manner, and assuming that the formation of each respective cube is such that each die face on each die has an equal probability of being randomly selected, then the probability of rolling (a) 7 or 11 on one roll, or (b) repeating the point 4, 5, 6, 8, 9, or 10 in the event that is the number obtained on the first roll, before 7 is rolled, is equal to ½. Also, using said combination of dice, the occurrence probability for the number 7 is three times that of either 4, 5, 8, or 10, but equal to that of both 6 and 9.

Accordingly, the objects and advantages of the invention are:

a) to provide a means of playing craps such that the probabilities of winning and losing outcomes on "pass" bets, "don't pass" bets, "come" bets, and "don't come" bets are each equal to ½;

b) by means of a) above, to allow for fair "pass" bets, fair "don't pass" bets, fair "come" bets, and fair "don't come" bets at even odds;

c) to provide a means of playing craps such that fair payoffs on "place" bets or "point" bets on each of the numbers 4, 5, 6, 8, 9, and 10 are integer multiples of the amount bet and;

d) by means of c) above, to remove the burden on the "place" bettor and "point" bettor to match amounts wagered to the fair mathematical payoff possible.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
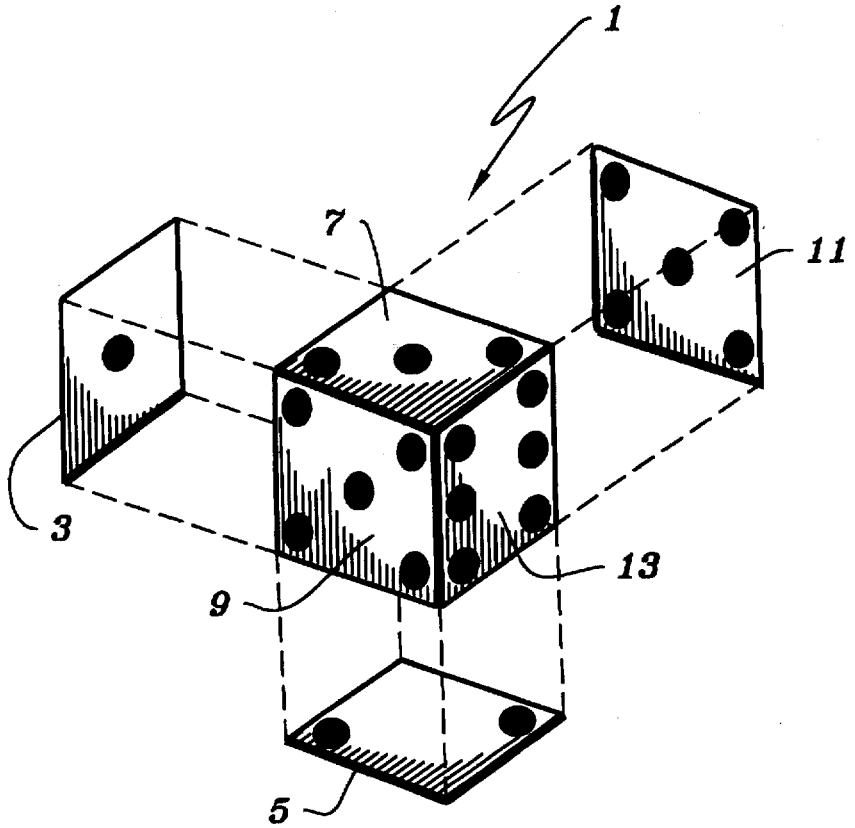
FIG. 1 is an isometric view of a first die showing the markings on the front, top, and right faces with projected views of the back, bottom, and left faces to illustrate their respective markings with symbols, shown here as spots, indicating values of the set of integers 1, 2, 3, 5, 5 and 6.
Figure 2:
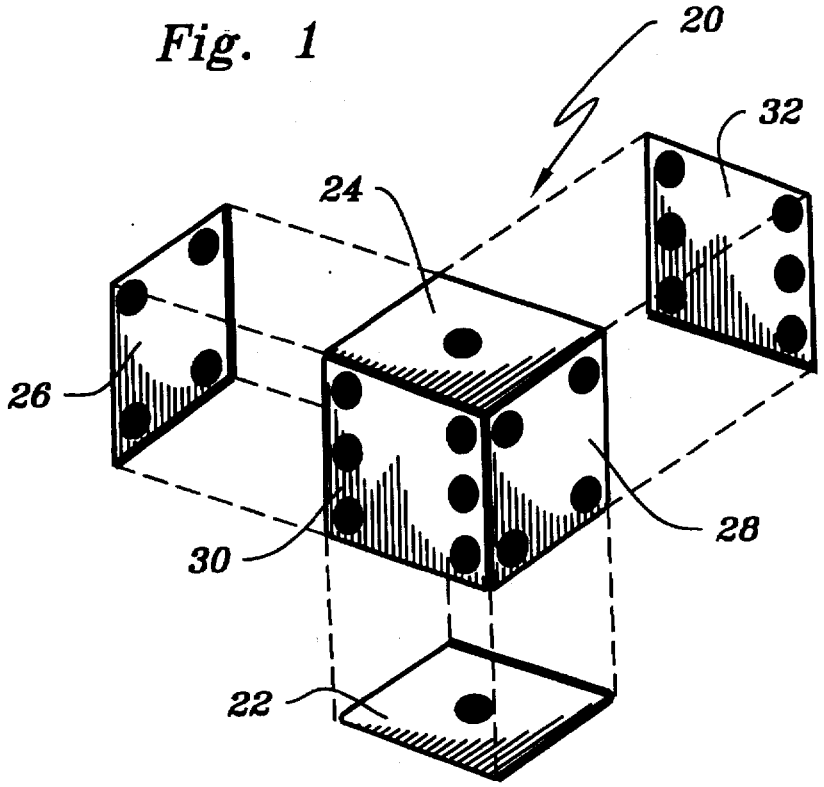
FIG. 2 is an isometric view of a second die showing the markings on the front, top, and right faces with projected views of the back, bottom, and left faces to illustrate their respective markings with symbols, shown here as spots, indicating values of the set of integers 1, 1, 4, 4, 6 and 6.

FIGS. 1 and 2 illustrates the preferred embodiment of the invention composed of a first and a second die, 1, 20, each a cube having six faces comprising a first, second, third, fourth, fifth and sixth face. The first through sixth faces on the first die, 1, are marked singly with symbols indicating the value of the set of integers 1, 2, 3, 5, 5, and 6 as shown by reference numerals 3, 5, 7, 9, 11 and 13. The first through sixth faces on the second die, 20, are marked singly with symbols indicating the value of the set of integers 1, 1, 4, 4, 6, and 6 as shown by reference numerals 22, 24, 26, 28, 30 and 32. The assigned integer on each face of each of the first and second die corresponds to the number of spots on those respective faces. Alternatively, the assigned integer for each face of each die may be in the form of a symbol, numeral or other means of depicting the integer value.

Figure 3:
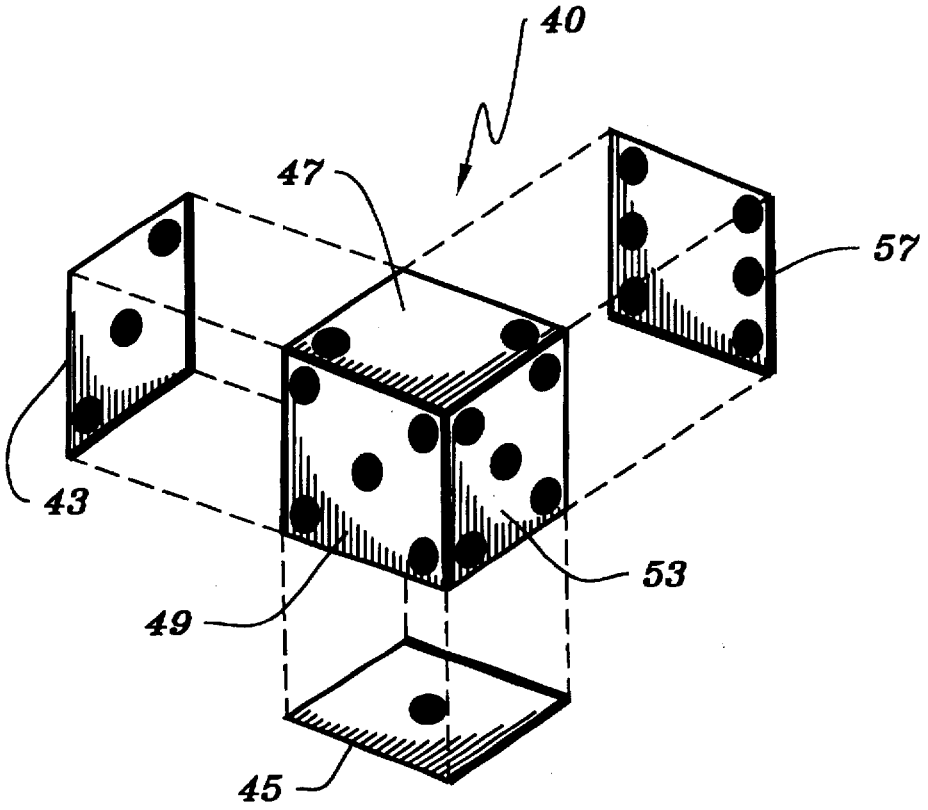
FIG. 3 is an isometric view of a first die showing the markings on the front, top, and right faces with projected views of the back, bottom, and left faces to illustrate the assignment of the symbols, shown as spots, indicating values of the set of integers 1, 2, 3, 5, 5 and 6 in an order differing from that depicted in FIG. 1.
Figure 4:
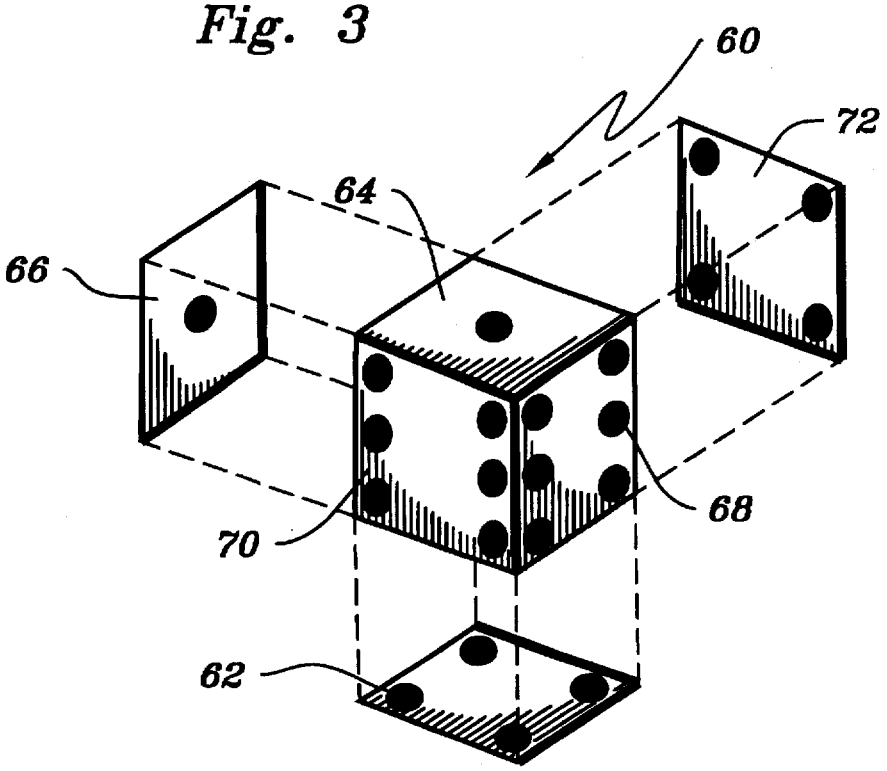
FIG. 4 is an isometric view of a second die showing the markings on the front, top, and right faces with projected views of the back, bottom, and left faces to illustrate the assignment of the symbols, shown as spots, indicating values of the set of integers 1, 1, 4, 4, 6 and 6 in an order differing from that depicted in FIG. 2.

The marking or symbol of the value of any single integer within the sets of integers identified for the first and second die may be assigned to any particular face among the six faces of each of the first and second die in any order, including, for example, randomly. FIGS. 3 and 4 illustrates an alternative embodiment wherein the markings of the faces of the first and second die are of an order differing from that depicted in FIGS. 1 and 2 to demonstrate that the faces may be marked in any order including randomly. FIGS. 3 and 4 depict a first and second die 40, 60 with first, second, third, fourth, fifth and sixth faces 43, 45, 47, 49, 51, 53, 62, 64, 66, 68, 70 and 72.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A first and second six faced die each having a first, second, third, fourth, fifth and sixth face wherein the six faces of the first die are marked randomly with symbols representing the value of the set of integers 1, 2, 3, 5, 5, and 6, and the six faces of the second die are marked randomly with symbols representing the value of the set of integers 1, 1, 4, 4, 6, and 6.

2. A first and second die according to claim 1 wherein each is formed as a cube.

3. A first and second die according to claim 1 formed such that each face of each of the first or second die have an equal probability of being randomly selected when rolled.

4. A cube shaped die having six faces comprising a first, second, third, fourth, fifth and sixth face with symbols representing the value of the set of integers 1, 2, 3, 5, 5, and 6 assigned singly to the six faces of said die such that the value of integer 1 is denoted on the first face, the value of integer 2 is denoted on the second face, the value of integer 3 is denoted on the third face, the value of integer 5 is denoted on both the fourth and fifth faces, and the value of integer 6 is denoted on the sixth face.

5. A die according to claim 4 wherein the six faces are marked randomly with symbols representing the value of the integers 1, 2, 3, 5, 5, and 6.

6. A die according to claim 4 wherein the symbol of the value of any single integer within the set of integers 1, 2, 3, 5, 5 and 6 are assigned to any particular face among the six faces of the die in any order.

7. A die according to claim 6 wherein the assignment of the value of any single integer to any particular face among the six faces is random.

8. A die according to claim 4 formed such that each face of the die has an equal probability of being randomly selected when rolled.

9. A cube shaped die having six faces comprising a first, second, third, fourth, fifth and sixth face with symbols representing the value of the set of integers 1, 1, 4, 4, 6, and 6 assigned singly to the six faces of said die such that the value of integer 1 is denoted on each of two faces, the value of integer 4 is denoted on each of two additional faces, and the value of integer 6 is denoted on each of the remaining two faces.

10. A die according to claim 9 wherein each of the six faces are marked randomly with symbols representing the value of the integers 1, 1, 4, 4, 6 and 6.

11. A die according to claim 9 wherein the symbol of the value of any single integer within the set of integers 1, 1, 4, 4, 6 and 6 are assigned to any particular face among the six faces of the die in any order.

12. A die according to claim 11 wherein the assignment of the value of any single integer to any particular face among the six faces is random.

13. A die according to claim 9 formed such that each face of the die has an equal probability of being randomly selected when rolled.

14. A pair of dice to be used in combination comprised of a first cube shaped die having six faces comprising a first, second, third, fourth, fifth and sixth face with symbols representing the value of the set of integers 1, 2, 3, 5, 5, and 6 assigned singly to the six faces of said first die such that the value of integer 1 is denoted on the first face, the value of integer 2 is denoted on the second face, the value of integer 3 is denoted on the third face, the value of integer 5 is denoted on both the fourth and fifth faces, and the value of integer 6 is denoted on the sixth face; a second cube shaped die having six faces comprising a first, second, third, fourth, fifth and sixth face with symbols representing the value of the set of integers 1, 1, 4, 4, 6, and 6 assigned singly to the six faces of said second die such that the value of integer 1 is denoted on each of two faces, the value of integer 4 is denoted on each of two additional faces, and the value of integer 6 is denoted on each of the remaining two faces.

* * * * *